US006105938A

United States Patent [19]

Koida

[11] Patent Number: 6,105,938

[45] Date of Patent: Aug. 22, 2000

[54] AGRICULTURAL ELEVATION SYSTEM

[76] Inventor: Richard Isao Koida, 10127 SE. 99th Dr., Portland, Oreg. 97266

[21] Appl. No.: 09/212,772

[22] Filed: Dec. 16, 1998

[51] Int. Cl.[7] ..... B66D 1/26

[52] U.S. Cl. ..... 254/278; 254/296; 254/362; 294/81.5

[58] Field of Search ..... 254/278, 294, 254/296, 316, 343, 362, 380; 198/346.3, 465.4; 294/81.1, 81.5, 81.56, 81.2

[56] References Cited

U.S. PATENT DOCUMENTS

| | | | |
|---|---|---|---|
| 410,507 | 9/1889 | Fain | 254/278 |
| 624,905 | 6/1899 | Boyd . | |
| 796,807 | 8/1905 | Cavanagh . | |
| 1,031,115 | 7/1912 | Hanson | 294/81.2 |
| 2,020,306 | 11/1935 | Fitch | 254/296 |
| 2,039,464 | 5/1936 | Troup | 254/343 X |
| 2,603,851 | 7/1952 | Hawkins | 254/296 X |
| 2,614,704 | 10/1952 | Winslow . | |
| 2,990,012 | 6/1961 | Riebling . | |
| 3,809,422 | 5/1974 | Schlough | 294/81.5 X |
| 4,438,903 | 3/1984 | Gagnon et al. | 254/316 X |
| 4,508,482 | 4/1985 | Duncan . | |
| 4,881,548 | 11/1989 | Kramer | 254/278 X |
| 5,280,880 | 1/1994 | Ewing et al. . | |
| 5,448,853 | 9/1995 | Harman . | |

*Primary Examiner*—Donald P. Walsh
*Assistant Examiner*—Emmanuel M. Marcelo
*Attorney, Agent, or Firm*—Christensen O'Connor Johnson & Kindness PLLC

[57] ABSTRACT

An agricultural or floricultural elevation system is provided for lifting and supporting agricultural or floricultural products or containers at a desired elevation above the ground. The system includes a spool shaft and a drive assembly. The drive assembly is operable from a location below the spool shaft, and is adapted to selectively rotate the spool shaft axially in a first direction and a second direction. The elevation system further includes a plurality of first lines having a first end and a second end. The first ends are secured to the spool shaft so that when the spool shaft is rotated in the first and second directions, the first lines are wound and unwound, respectively, around the spool shaft. The system also includes a hanger rod that is secured to the second ends of the first lines to suspend from the spool shaft. In operation, a user secures agricultural or floricultural products or containers to the hanger rod. By operating the drive assembly at a location below the spool shaft, a user may hoist or lower the hanger rod and, hence, the agricultural products or containers secured thereto.

18 Claims, 3 Drawing Sheets

AGRICULTURAL ELEVATION SYSTEM

FIELD OF THE INVENTION

The present invention is directed to systems and methods for lifting and supporting agricultural or floricultural products or containers at a desired elevation above the ground for growing, processing, or storage.

BACKGROUND OF THE INVENTION

The agricultural and floricultural industries are continuously searching for systems and methods that maximize the use of often limited space available for growing, processing, or storing various agricultural or floricultural products or containers. For example, U.S. Pat. No. 2,614,704 issued to Winslow describes a device for loading and hoisting banana bunches for easy transportation and space-efficient storage of the products. U.S. Pat. No. 4,508,482 issued to Duncan describes a method and apparatus for storing tobacco inside a barn from the top downward for curing. Both Winslow and Duncan, however, describe relatively complex systems suitable for use with only one particular agricultural product, i.e., bananas and tobacco, respectively. Thus, these systems lack versa tile utility in various agricultural or floricultural structures available today, for example, a greenhouse used for growing various agricultural or floricultural products. Most greenhouses are at least 12- to 16-feet high as measured between the ground and their gutters, and the space high above the ground inside a greenhouse is typically wasted as dead space.

A need exists for a versatile system and method for lifting and supporting various agricultural or floricultural products at a desired elevation above the ground, to make better use of limited spaces available for growing, processing, or storing the products. Preferably, such system and method entail a simple structure, which is easily adaptable to various sites, including inside of a greenhouse. Further preferably, such system and method require only easily obtainable materials and parts to achieve low manufacturing and operation costs.

SUMMARY OF THE INVENTION

The present invention provides an agricultural or floricultural elevation system for lifting and supporting agricultural or floricultural products or containers at a desired elevation above the ground. The elevation system includes a spool shaft and a drive assembly. The drive assembly is operable from a location below the spool shaft, and is adapted to selectively rotate the spool shaft axially in a first direction and a second direction, for example, clockwise and counterclockwise or counterclockwise and clockwise. The elevation system further includes a plurality of first lines, each having a first end and a second end. The first ends of the first lines are secured to the spool shaft at spaced-apart locations along the length of the spool shaft. The first lines are secured to the spool shaft in such a manner that the first lines are wound around the spool shaft when the spool shaft is rotated in the first direction, and are unwound around the spool shaft when the spool shaft is rotated in the second direction. The elevation system further includes a first hanger rod, which is secured to the second ends of the first lines to suspend from the spool shaft. Thus, the first hanger rod is raised when the first lines are wound around the spool shaft, and is lowered when the lines are unwound around the spool shaft.

In operation, at least one agricultural or floricultural product or container is attached to the first hanger rod. As a user operates the drive assembly from the ground to rotate the spool shaft in the first direction, the first hanger rod together with the at least one product or container is hoisted above the ground. The user thus can make the maximum use of the space below the spool shaft. To lower the first hanger rod, the user operates the drive assembly to rotate the spool shaft in the second direction.

In accordance with one aspect of the present invention, the elevation system of the invention may be conveniently mounted on the truss structure of an agricultural/floricultural structure, such as a greenhouse.

In accordance with another aspect of the invention, the elevation system may further include a second hanger rod, which suspends from the first hanger rod via a plurality of second lines, for holding additional products or containers.

In accordance with yet another aspect of the invention, the drive assembly is formed of a worm gear and a toothed wheel mated therewith. The drive assembly further includes an actuator, which allows a person to operate the drive assembly at a location below the spool shaft.

In accordance with a further aspect of the invention, an irrigation tube may be secured along the first and/or second hanger rod for convenient irrigation.

The present invention also provides a method of elevating and supporting agricultural or floricultural products or containers at a desired elevation above the ground inside an agricultural or floricultural structure, using the elevation system of the present invention described above.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
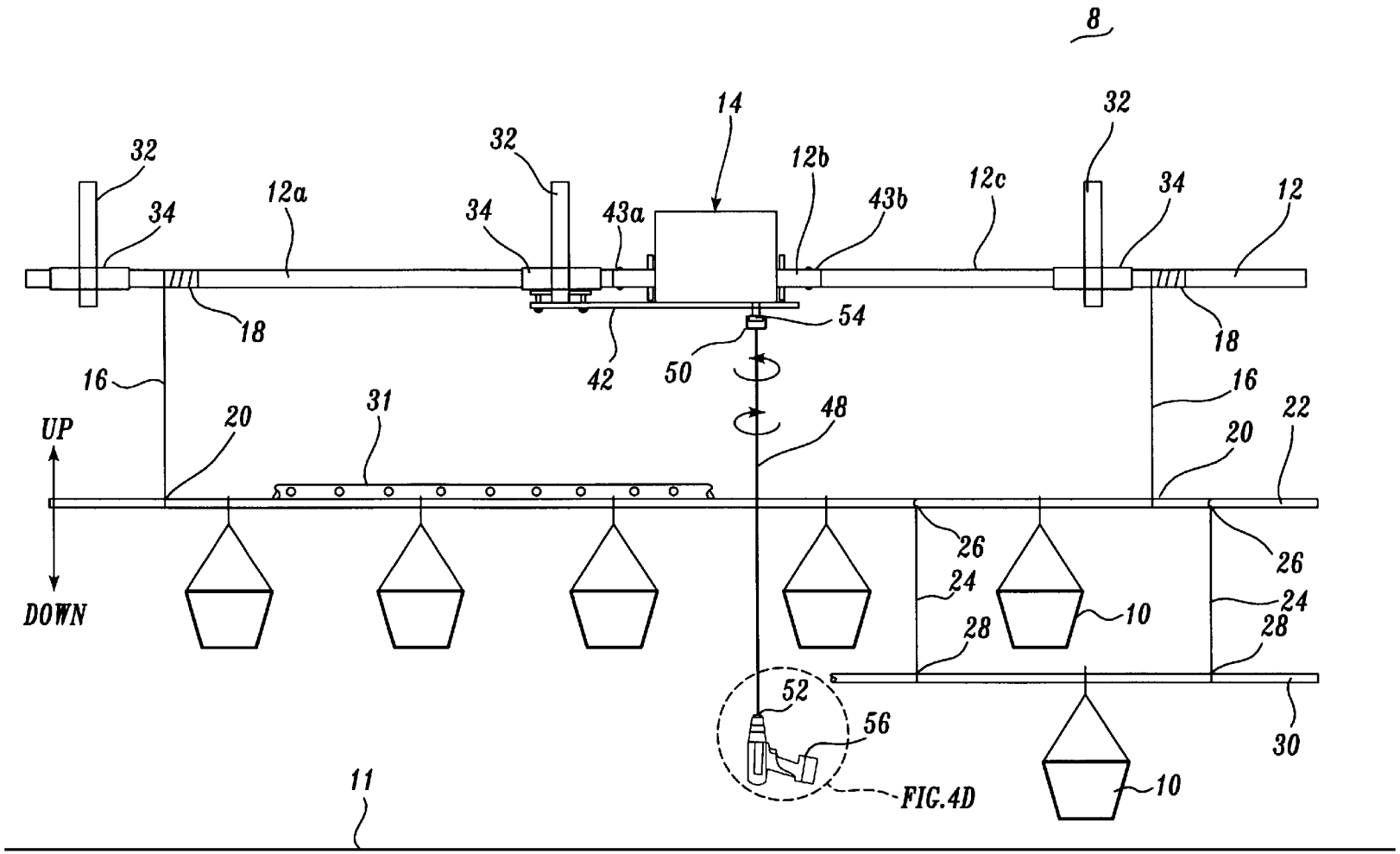
FIG. 1 is a schematic side view of an agricultural or floricultural elevation system in accordance with the present invention.

FIG. 1 illustrates an agricultural or floricultural elevation system 8 of the present invention for lifting and supporting agricultural or floricultural products or containers 10 at a desired elevation above the ground 11. The elevation system 8 includes a spool shaft preferably in the form of an elongate pipe 12, and a drive assembly 14. Drive assembly 14 is operable from a location below spool shaft 12, and is adapted to selectively rotate the spool shaft axially in a first direction and a second direction, for example, clockwise and counterclockwise or counterclockwise and clockwise. The elevation system 8 further includes a plurality of first lines or cables 16, each having a first end 18 and a second end 20. First ends 18 of first lines 16 are secured to spool shaft 12 at spaced-apart locations along the length of spool shaft 12. First lines 16 are secured to spool shaft 12 in such a manner that first lines 16 are wound around spool shaft 12 when spool shaft 12 is rotated in the first direction, and are unwound around spool shaft 12 when spool shaft 12 is rotated in the second direction. The elevation system 8 further includes a first hanger rod preferably in the form of an elongate pipe 22, which is secured to second ends 20 of first lines 16 to suspend from spool shaft 12. Thus, first hanger rod 22 is raised when lines 16 are wound around spool shaft 12, and is lowered when lines 16 are unwound around spool shaft 12.

Optionally, elevation system 8 may further include a plurality of second lines or cables 24 having a first end 26 and a second end 28. First ends 26 of second lines 24 are secured to first hanger rod 22. Elevation system 8 may further include a second hanger rod preferably in the form of an elongate pipe 30 (only partially shown), which is secured to second ends 28 of second lines 24 to suspend from first hanger rod 22. Thus, second hanger rod 30 is raised when lines 16 are wound around spool shaft 12, and is lowered when lines 16 are unwound around spool shaft 12.

Further optionally, an irrigation pipe 31 (only partially shown) may be secured along first and/or second hanger rods 22, 30 for irrigation in a convenient manner.

Elevation system 8 may be placed outside, using a suitable support frame (not shown) for supporting spool shaft 12 at a predetermined elevation above the ground. Also, elevation system 8 may be placed inside an agricultural or floricultural structure, such as a greenhouse, having a truss structure 32 (only partially shown). Spool shaft 12 may then be conveniently mounted to truss structure 32 at a predetermined height above the ground, without requiring any additional support frame structure. In mounting spool shaft 12 to truss structure 32, it may be preferable to extend spool shaft 12 through support collars in the form of a short-length pipe 34, for example PVC pipe, at locations where spool shaft 12 meets truss structure 32.

Figure 2A:
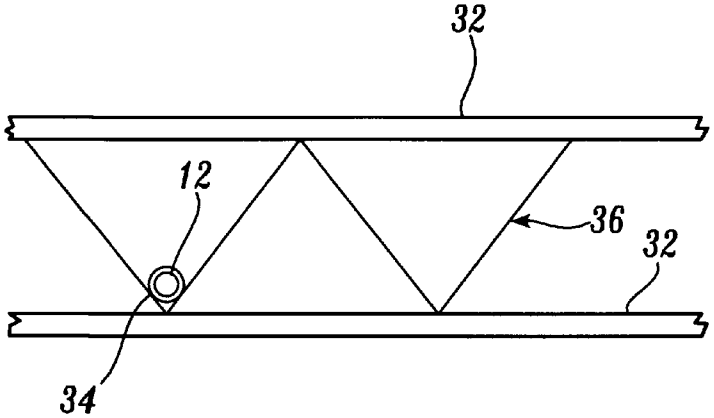
FIG. 2A is a partial elevational view illustrating an example of a method of mounting a spool shaft to a truss structure of a greenhouse, in accordance with the present invention.
Figure 2B:
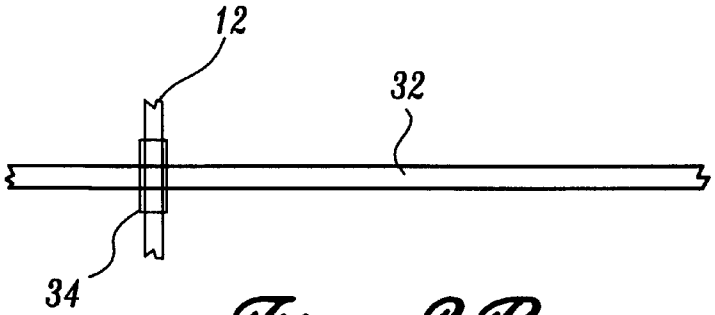
FIG. 2B is a top or plan view of FIG. 2A.
Figure 3A:
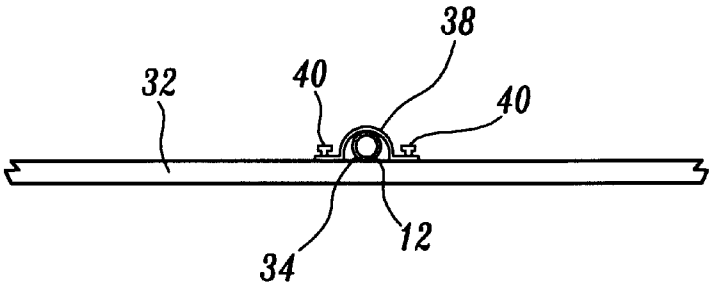
FIG. 3A is a partial elevational view of another example of a method of mounting a spool shaft to a truss structure of a greenhouse, in accordance with the present invention.
Figure 3B:
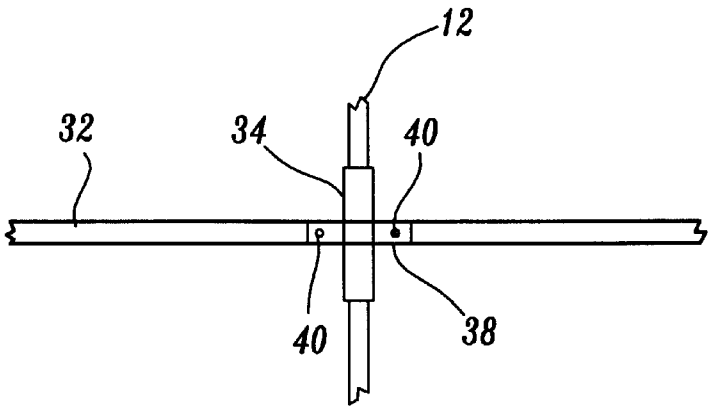
FIG. 3B is a top or plan view of FIG. 3A.

FIGS. 2A and 2B illustrate a method of securing spool shaft 12 onto truss structure 32 having a web structure 36. Spool shaft 12 extending a short length through support collar 34 is held in place within web structure 36. FIGS. 3A and 3B illustrate another method of installing spool shaft 12 onto truss structure 32. Spool shaft 12 is placed generally perpendicular to truss structure 32. As before, spool shaft 12 extends a short length through support collar 34 where spool shaft 12 meets truss structure 32. A pipe saddle clamp 38 is provided to perpendicularly fit over support collar 34, and saddle clamp 38 is attached to truss structure 32 using a suitable means, such as screws 40. It should be understood that FIGS. 2A–3B are provided for illustrative purposes only, and various other methods of installing spool shaft 12 onto truss structures or other types of shoulders will be apparent to those skilled in the art.

When spool shaft 12 is mounted to truss structure 32, first ends 18 of first lines 16 are secured to spool shaft 12 at spaced-apart locations between the trusses.

Spool shaft 12 and first and second hanger rods 22, 30 may be made of any suitable longitudinal material or structure, such as pipes. The length and material composition of spool shaft 12 and first and second hanger rods 22, 30 are determined based primarily on the maximum lifting capacity of drive assembly 14, as will be apparent to those skilled in the art. First and second lines 16, 24 may be made of materials such as cables, chains, and ropes, as nonlimiting examples. Preferably, lines 16, 24 are formed of galvanized steel cables so as to not rust in the humid atmosphere of a greenhouse.

As described above, drive assembly 14 is operable from a location below spool shaft 12 and ideally by someone standing on the ground. Also, the drive assembly is adapted to selectively rotate spool shaft 12 axially in the first direction to hoist first hanger rod 22, and in the second direction to lower the same. When elevation system 8 of the present invention is used inside a greenhouse having truss structure 32, drive assembly 14 may be supported by truss structure 32 using any suitable means, such as bolts and straps, collectively represented by numeral 42 in FIG. 1.

For ease of manufacturing and installation of the present elevation system 8, it may be preferable to form spool shaft 12 with three sections: a first section 12*a,* a second section 12*b* having a first end 43*a* and a second end 43*b,* and a third section 12*c*. The drive assembly 14 is secured to the second section 12*b*. Then, the second section 12*b* is coupled at its first end 43*a* to the first section 12*a,* and at its second end 43*b* to the third section 12*c,* to complete the spool shaft 12. This coupling of the spool shaft sections can be carried out using any suitable means.

Figure 4B:
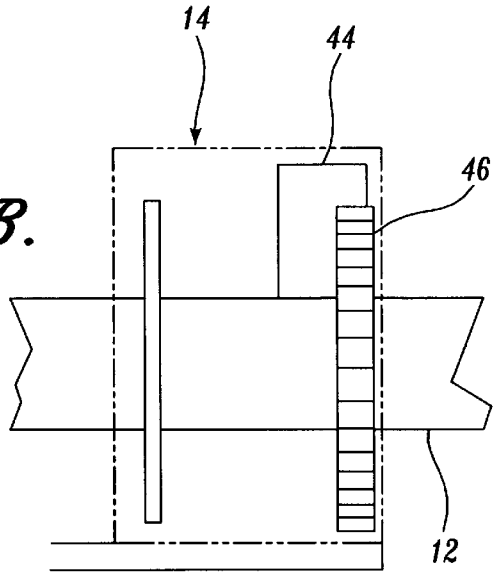
FIG. 4B is an elevational view of a drive assembly including the worm gear and the toothed wheel of FIG. 4A.
Figure 4D:
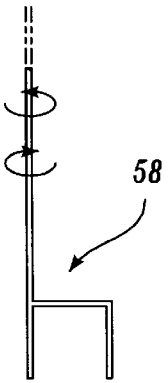
FIG. 4D is an alternative view at circle 4D of FIG. 1, illustrating a handcrank replacing an electric drill of FIG. 1.
Figure 4A:
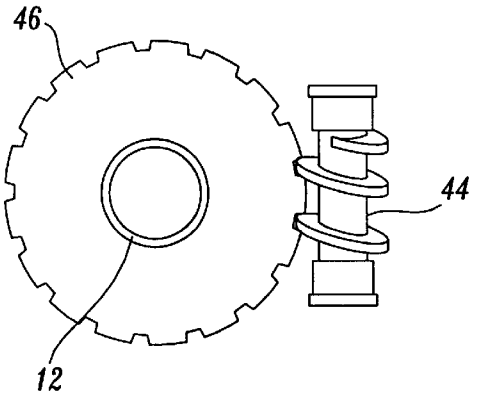
FIG. 4A illustrates a worm gear and a toothed wheel that are suitable for forming a drive assembly of the present invention.
Figure 4C:
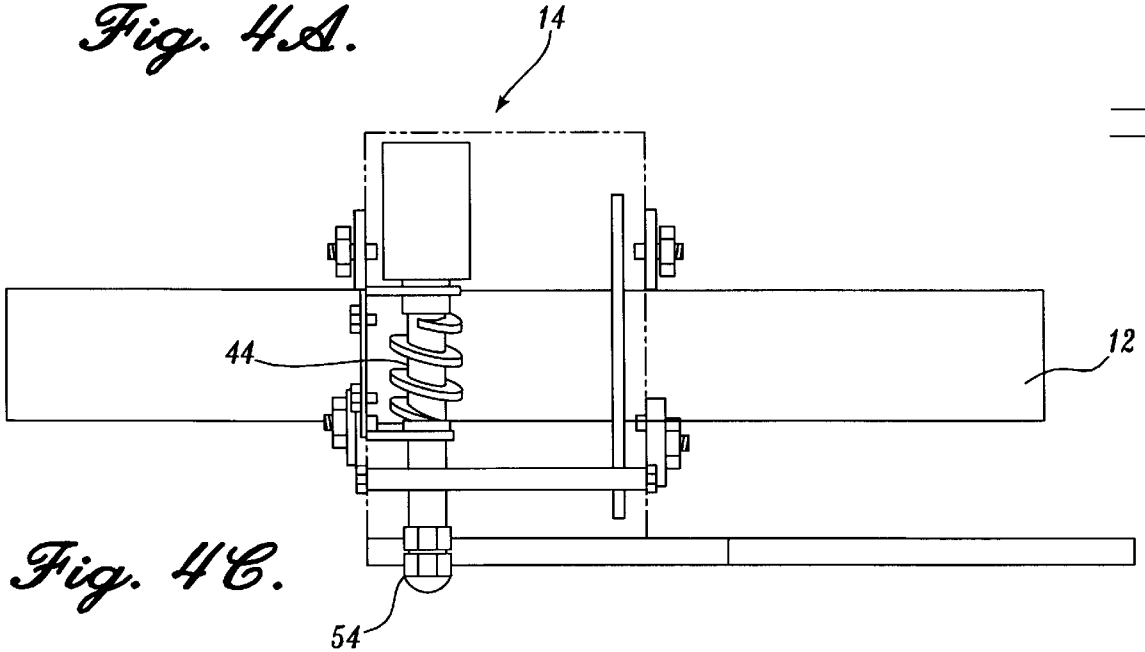
FIG. 4C is another elevational view of the drive assembly of FIG. 4B, viewed from the opposite side of FIG. 4B.

Referring additionally to FIGS. 4A, 4B, and 4C, drive assembly 14 may be composed of a worm gear 44 mated with a toothed wheel 46. Toothed wheel 46 is coaxially coupled to spool shaft 12, so that when worm gear 44 turns in one direction and the other direction, toothed wheel 46 and spool shaft 12 turn in the first direction and the second direction to wind and unwind, respectively, first lines 16 around spool shaft 12. The combination of worm gear 44 and toothed wheel 46 thus allows for selectively rotating spool shaft 12 in either direction and, further, for stopping the rotation at any desired position. Thus, the combination allows lifting and supporting first and second hanger rods 22, 30 at a desired elevation above the ground. It should be understood that those skilled in the art may readily construct other drive assemblies that allow for selective rotation of spool shaft 12.

Drive assembly 14 further includes an actuator for selectively rotating the worm gear 44 from the ground. An example of such actuator is described in reference to FIGS. 1 and 4C. A rod 48 having a first end 50 and a second end 52 is coupled at first end 50 to worm gear 44 via a socket 54. Rod 48 has a sufficient length so that its second end 52 is accessible to a person on the ground. As a person axially rotates rod 48 in one or the other direction, worm gear 44 turns in the same direction, thereby rotating spool shaft 12 in the first or second direction. To facilitate easy rotation of rod 48, an electric rotator in the form of an electric drill 56 may be detachably coupled to second end 52 of rod 48. Alternatively, as shown in FIG. 4D, a handcrank 58 may be detachably coupled to second end 52 of rod 48. It should be understood that many types of actuators may be used to selectively rotate worm gear 44 from a location below spool shaft 12, and will be apparent to those skilled in the art.

Still referring to FIG. 1, in operation, a user places at least one agricultural or floricultural product or container 10, for example a plurality of flower pots as illustrated in FIG. 1, on first and second hanger rods 22, 30. As a person operates drive assembly 14 from the ground to rotate spool shaft 12 in the first direction, hanger rods 22, 30 are hoisted high above the ground to allow for maximum use of the space below spool shaft 12. When the elevation system 8 of the invention is used inside an agricultural or floricultural structure, such as a greenhouse, the system allows more efficient use of the space inside the structure. To lower hanger rods 22, 30 and, hence, the products or containers attached thereto, a person operates drive assembly 14 from the ground level to rotate spool shaft 12 in the second direction. Once hanger rods 22, 30 are lowered, a person can easily handle, prune, apply water and chemical materials, and/or harvest the agricultural or floricultural products.

While the preferred embodiments of the invention have been illustrated and described, it will be appreciated that various changes can be made therein without departing from the spirit and scope of the invention.

The embodiments of the invention in which an exclusive property or privilege is claimed are defined as follows:

1. An elevation system for lifting and supporting agricultural or floricultural products or containers at a desired elevation above the ground for growing, processing, or storage, the system being adapted for use in an agricultural or floricultural structure having an overhead frame structure, comprising:

a spool shaft;

a drive assembly operable from a location below the spool shaft, wherein the drive assembly selectively rotates the spool shaft about the longitudinal axis of the spool shaft in both a first direction and a second direction;

a plurality of first lines having a first end and a second end, the first ends of the lines being secured to the spool shaft at spaced-apart locations along the length of the spool shaft, the lines being wound around the spool shaft when the spool shaft is rotated in the first direction, the lines being unwound around the spool shaft when the spool shaft is rotated in the second direction; and a first hanger rod being secured to the second ends of the lines to suspend from the spool shaft, the first hanger rod being raised when the lines are wound around the spool shaft, the first hanger rod being lowered when the lines are unwound around the spool shaft.

2. The system of claim 1, further comprising an irrigation tube secured along the first hanger rod.

3. The system of claim 1, which is adapted for use inside an agricultural or floricultural structure further having a truss structure within, the spool shaft being secured to the truss structure at a predetermined height from the ground.

4. The system of claim 3, further comprising support collars, wherein the spool shaft extends short lengths through the support collars at locations where the spool shaft meets the truss structure.

5. The system of claim 1, wherein the drive assembly comprises a worm gear and a toothed wheel mated therewith, the toothed wheel being coaxially coupled to the spool shaft, the drive assembly further comprising an actuator adapted to selectively rotate the worm gear about the longitudinal axis of the worm gear in one direction and the other direction.

6. The system of claim 5, wherein the spool shaft comprises a first section, a second section having a first end and a second end, and a third section, the three spool shafts being coaxially aligned, the first section being secured to the first end of the second section, the third section being secured to the second end of the second section, the toothed wheel being coaxially secured to the second section.

7. The system of claim 5, wherein the actuator comprises a rod coupled to the worm gear, the rod having a first end and a second end, the second end being placed closer to the ground than the first end to be accessible to a person on the ground.

8. The system of claim 7, wherein the actuator further comprises an electric rotator detachably coupleable to the second end of the rod to selectively rotate the rod about the longitudinal axis of the rod in one direction and the other direction.

9. The system of claim 7, wherein the actuator further comprises a handcrank detachably coupleable to the second end of the rod to selectively rotate the rod about the longitudinal axis of the rod in one direction and the other direction.

10. A method of elevating and supporting agricultural or floricultural products or containers at a desired elevation above the ground for growing, processing, or storage, inside an agricultural or floricultural structure having an overhead frame structure, comprising:

mounting a spool shaft inside the agricultural or floricultural structure at a predetermined height from the ground;

providing a plurality of lines having a first end and a second end at spaced-apart locations along the length of the spool shaft, the first ends of the lines being secured to the spool shaft;

providing a hanger rod being secured to the second ends of the lines to suspend the rod from the spool shaft;

placing at least one agricultural or floricultural product or container on the hanger rod; and rotating the spool shaft about the longitudinal axis of the spool shaft in a first direction and in a second direction, thereby winding and unwinding the lines around the spool shaft, respectively, thereby raising and lowering the hanger rod, respectively, and the at least one product or container.

11. The method of claim 10, wherein the rotation of the spool shaft comprises:

providing a drive assembly operable from a location below the spool shaft adapted to selectively rotate the spool shaft in the first direction and in the second direction; and operating the drive assembly from a location below the spool shaft.

12. The method of claim 11, wherein the drive assembly comprises a worm gear and a toothed wheel mated therewith, the toothed wheel being coaxially coupled to the spool shaft, the drive assembly further comprising a rod coupled to the worm gear, the rod having a first end and a second end, the second end being placed closer to the ground than the first end to be accessible to a person on the ground, the operation of the drive assembly comprising rotating the second end of the rod about the longitudinal axis of the rod in one direction and the other direction.

13. An elevation system for lifting and supporting agricultural or floricultural products or containers at a desired elevation above the ground inside an agricultural or floricultural structure for growing, processing, or storage, comprising:

a spool shaft mountable inside the agricultural or floricultural structure at a predetermined height from the ground;

a drive assembly operable from a location below the spool shaft adapted to selectively rotate the spool shaft about the longitudinal axis of the spool shaft in a first direction and a second direction;

a plurality of first lines having a first end and a second end, the first ends of the first lines being secured to the spool shaft at spaced-apart locations along the length of the spool shaft, the first lines being wound around the spool shaft when the spool shaft is rotated in the first direction, the first lines being unwound around the spool shaft when the spool shaft is rotated in the second direction;

a first hanger rod being secured to the second ends of the first lines to suspend from the spool shaft, the first hanger rod being raised when the first lines are wound around the spool shaft, the first hanger rod being lowered when the first lines are unwound around the spool shaft;

a plurality of second lines having a first end and a second end, the first ends of the second lines being secured to the first hanger rod; and a second hanger rod being secured to the second ends of the second lines to suspend from the first hanger rod.

14. The system of claim 13, wherein the agricultural or floricultural structure further has a truss structure within, the spool shaft being securable to the truss structure.

15. The system of claim 13, wherein the drive assembly comprises a worm gear and a toothed wheel mated therewith, the toothed wheel being coaxially coupled to the spool shaft, the drive assembly further comprising an actuator adapted to selectively rotate the worm gear about the longitudinal axis of the worm gear in one direction and the other direction.

16. The system of claim 15, wherein the actuator comprises a rod coupled to the worm gear, the rod having a first end and a second end, the second end being placed closer to the ground than the first end to be accessible to a person on the ground.

17. The system of claim 16, wherein the actuator further comprises an electric rotator detachably coupleable to the second end of the rod to selectively rotate the rod about the longitudinal axis of the rod in one direction and the other direction.

18. The system of claim 16, wherein the actuator further comprises a handcrank detachably coupleable to the second end of the rod to selectively rotate the rod about the longitudinal axis of the rod in one direction and the other direction.

* * * * *

UNITED STATES PATENT AND TRADEMARK OFFICE

CERTIFICATE OF CORRECTION

PATENT NO. : 6,105,938

DATED : August 22, 2000

INVENTOR(S) : R.I. Koida

It is certified that error appears in the above-identified patent and that said Letters Patent is hereby corrected as shown below:

| COLUMN | LINE | ERROR |
|---|---|---|
| [60] Pg. 1, col. 1 | Related U.S. Application Data | insert the following in appropriate order --[60] **Related U.S. Application Data** Provisional application No. 60/069,878, Dec. 16, 1997.-- |

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*